US012480365B2

(12) United States Patent
Wang et al.

(10) Patent No.: US 12,480,365 B2
(45) Date of Patent: Nov. 25, 2025

(54) STATE SELF-ADAPTIVE TURBINE TYPE PULSE GENERATOR AND DOWNHOLE DRILLING TOOL

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Jiachang Wang, Beijing (CN); Guangjun Ma, Beijing (CN); Haiping Zhang, Beijing (CN); Yanbin Zang, Beijing (CN); Lingchao Xuan, Beijing (CN); Dongqing Zhang, Beijing (CN); Jianhua Liu, Beijing (CN); Renlong Zhang, Beijing (CN); Lishuang Wang, Beijing (CN)

(73) Assignees: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

( * ) Notice: Subject to any disclaimer, the term of this patent is extended or adjusted under 35 U.S.C. 154(b) by 0 days.

(21) Appl. No.: 18/724,512

(22) PCT Filed: Sep. 22, 2022

(86) PCT No.: PCT/CN2022/120521
§ 371 (c)(1),
(2) Date: Jun. 26, 2024

(87) PCT Pub. No.: WO2023/124294
PCT Pub. Date: Jul. 6, 2023

(65) Prior Publication Data
US 2025/0092740 A1 Mar. 20, 2025

(30) Foreign Application Priority Data
Dec. 27, 2021 (CN) ..... 202111615130.2

(51) Int. Cl.
*E21B 7/24* (2006.01)
*E21B 4/02* (2006.01)
*E21B 6/06* (2006.01)

(52) U.S. Cl.
CPC ..... *E21B 7/24* (2013.01); *E21B 4/02* (2013.01); *E21B 6/06* (2013.01)

(58) Field of Classification Search
CPC ..... E21B 4/02; E21B 6/06; E21B 7/24; E21B 47/20; E21B 47/24
See application file for complete search history.

(56) References Cited

U.S. PATENT DOCUMENTS 2,738,956 A * 3/1956 Bielstein ..... E21B 4/14 173/121
4,396,071 A * 8/1983 Stephens ..... E21B 41/0085 175/50

(Continued)

FOREIGN PATENT DOCUMENTS

CA 1285551 C 7/1991
CN 105089501 A 11/2015

(Continued)

*Primary Examiner* — Jennifer H Gay
(74) *Attorney, Agent, or Firm* — NKL Law; Allen Xue

(57) ABSTRACT

A turbine type pulse generator for downhole drilling tool has a pulse generating device (2), which has a turbine housing (21), a turbine shaft (22) concentrically arranged inside the turbine housing (21), a turbine mechanism arranged around the turbine shaft (22), and a valve disc mechanism provided at a lower end of the turbine shaft (22). The turbine mechanism is configured to drive the turbine shaft (22) to rotate under an impact of drilling fluid, so that a flow area of the valve disc mechanism is changed periodically to generate (Continued)

pressure pulses. The turbine type pulse generator also has an automatic control mechanism (1) configured to keep the turbine shaft (22) static relative to the turbine housing (21) in a circumferential direction during composite drilling, and to drive the turbine shaft (22) to rotate relative to the turbine housing (21) under an impact of the turbine mechanism during sliding drilling.

17 Claims, 3 Drawing Sheets

(56) References Cited

U.S. PATENT DOCUMENTS

| | | | | |
|---|---|---|---|---|
| 8,469,104 | B2 * | 6/2013 | Downton | E21B 34/06 166/330 |
| 9,765,584 | B2 * | 9/2017 | Lorenson | E21B 4/02 |
| 10,619,437 | B2 * | 4/2020 | Lorenson | E21B 4/02 |
| 10,829,993 | B1 * | 11/2020 | von Gynz-Rekowski | E21B 21/10 |
| 11,680,455 | B2 * | 6/2023 | Doster | E21B 34/10 166/177.6 |
| 11,753,901 | B2 * | 9/2023 | Schultz | E21B 7/24 166/316 |
| 11,959,349 | B2 * | 4/2024 | Oberlin | E21B 28/00 |
| 12,305,481 | B2 * | 5/2025 | von Gynz-Rekowski | E21B 4/02 |
| 2011/0056695 | A1 * | 3/2011 | Downton | E21B 41/00 175/57 |
| 2016/0281449 | A1 * | 9/2016 | Lorenson | E21B 21/10 |
| 2017/0122034 | A1 * | 5/2017 | Nichols | E21B 28/00 |
| 2018/0340388 | A1 * | 11/2018 | Lorenson | E21B 4/02 |
| 2019/0330931 | A1 | 10/2019 | Zeng et al. | |
| 2020/0149367 | A1 * | 5/2020 | Doster | E21B 7/24 |
| 2021/0277743 | A1 * | 9/2021 | Schultz | E21B 47/20 |
| 2023/0027048 | A1 * | 1/2023 | Oberlin | E21B 7/24 |
| 2023/0323748 | A1 * | 10/2023 | Doster | E21B 31/005 166/177.6 |
| 2024/0410252 | A1 * | 12/2024 | von Gynz-Rekowski | E21B 4/02 |
| 2025/0092740 | A1 * | 3/2025 | Wang | E21B 4/02 |

FOREIGN PATENT DOCUMENTS

| | | | | | |
|---|---|---|---|---|---|
| CN | 106639944 | A | | 5/2017 | |
| CN | 106640058 | A | | 5/2017 | |
| CN | 106761413 | A | | 5/2017 | |
| CN | 206280029 | U | | 6/2017 | |
| CN | 107420033 | A | | 12/2017 | |
| CN | 107636248 | A | | 1/2018 | |
| CN | 108843236 | A | * | 11/2018 | E21B 4/02 |
| CN | 110905400 | A | | 3/2020 | |
| CN | 111255379 | A | * | 6/2020 | E21B 4/14 |
| CN | 111577141 | A | | 8/2020 | |
| CN | 213540263 | U | | 6/2021 | |
| CN | 113775335 | A | * | 12/2021 | E21B 47/12 |
| CN | 114135230 | A | * | 3/2022 | E21B 7/24 |
| CN | 116771321 | A | * | 9/2023 | E21B 44/005 |
| SU | 374439 | A1 | | 3/1973 | |

* cited by examiner

STATE SELF-ADAPTIVE TURBINE TYPE PULSE GENERATOR AND DOWNHOLE DRILLING TOOL

CROSS REFERENCE OF RELATED APPLICATIONS

This application is a U.S. national stage entry of PCT International Application No. PCT/CN2022/120521, filed on Sep. 22, 2022, which claims the priority of Chinese patent application No. 202111615130.2 entitled "STATE SELF-ADAPTIVE TURBINE TYPE PULSE GENERATOR" and filed on Dec. 27, 2021, the content of each is incorporated herein by reference in its entirety.

TECHNICAL FIELD

The present invention relates to the technical field of drilling, and specifically to a state self-adaptive turbine type pulse generator. The present invention also relates to a downhole drilling tool.

TECHNICAL BACKGROUND

In the drilling of extended reach wells and horizontal wells, most of the weight of the drilling string in the inclined section of extended reach well is supported by the well wall due to large inclination angle. Therefore, the friction between pipe string and wellbore is large, which leads to backing pressure and increased torque. Since the weight on bit is discontinuous or limited, it is difficult to perform drilling only relying on the weight of the drilling tool in its straight section, and also to control the tool face, resulting in limited length of drilled horizontal section and low rate of penetration. Accordingly, a pressure pulse generator and an axial vibration generator associated therewith have been introduced in the downhole pipe string. Then, pressure pulses generated by periodically changing the fluid flow area of the pressure pulse generator act on the axial vibration generator to drive the drilling tool to reciprocate axially, which reduces the friction coefficient between the pipe string and the well wall during sliding drilling, lowering the frictional resistance of the pipe string, and eliminating the backing pressure of the drilling string, thereby improving the transmission effect of weight on bit and increasing the efficiency of directional drilling.

CN105089501A discloses a hydraulic oscillator, CN106639944A discloses a turbo-type underground hydraulic oscillator, CN106761413A discloses a hydraulic oscillator, and CN206280029U also discloses a hydraulic oscillator. The above-mentioned hydraulic oscillators each comprise a pulsing system that generates hydraulic pulses through a short turbine-driven valve assembly. In addition, the pulsing system in each of the above-mentioned turbo-type hydraulic oscillators is always in a working state during directional drilling. However, since the drilling string is rotatable under composite drilling conditions and thus no backing pressure is generated, the hydraulic oscillator in the working state does not have much effect on the drilling operation. However, erosion of the valve assembly will be aggravated when the hydraulic oscillator is in the working state. Therefore, the service life of the pulsing system will be shortened if the hydraulic oscillator is always in the working state, which will seriously affect the friction-reducing and anti-backing pressure effect of the drilling tool in a later stage of use.

SUMMARY OF THE INVENTION

In view of the above technical problems, the present invention proposes a turbine type pulse generator for downhole drilling tool. The turbine type pulse generator can realize automatic braking or rotation of turbine shaft by switching between rotating and non-rotating states of the drilling string, thereby realizing automatic control of the working state of the turbine type pulse generator. That is, the pulse generator stops working under composite drilling condition but starts working under sliding drilling condition, which greatly extend the service life of the valve assembly and significantly improve the friction-reducing and anti-backing pressure effect of the drilling string in later-stage use of the drilling tool during directional drilling operation.

Aiming at solving the above technical problems, a first aspect of the present invention proposes a turbine type pulse generator for downhole drilling tool, which comprises a pulse generating device, comprising a turbine housing, a turbine shaft concentrically arranged inside the turbine housing, a turbine mechanism arranged around the turbine shaft, and a valve disc mechanism provided at a lower end of the turbine shaft. The turbine mechanism is configured to drive the turbine shaft to rotate relative to the turbine housing under an impact of drilling fluid, so that a flow area of the valve disc mechanism is changed periodically to generate pressure pulses. The turbine type pulse generator further comprises an automatic control mechanism configured to control a state of the pulse generating device. The automatic control mechanism is configured to keep the turbine shaft static relative to the turbine housing in a circumferential direction during composite drilling, so that the pulse generating device is in a non-working state, and to drive the turbine shaft to rotate relative to the turbine housing under an impact of the turbine mechanism during sliding drilling, so that the pulse generating device is in a working state.

In one embodiment, the automatic control mechanism comprises an outer cylinder fixedly connected to an upper end of the turbine housing, a movable unit arranged within the outer cylinder, and a drive assembly for driving the movable unit to move in an axial direction, wherein the turbine shaft has a block extending inward in a radial direction, and the drive assembly is configured to drive the movable unit to move toward and engage with the block during the composite drilling, so that the turbine shaft is static relative to the turbine housing in the circumferential direction, and to drive the movable unit to move away from and disengage from the block during the sliding drilling, so that the turbine shaft is rotatable relative to the turbine housing.

In one embodiment, the movable unit includes a first slider and a second slider axially spaced apart from each other within the outer cylinder, both the first slider and the second slider being circumferentially fixed to the outer cylinder but axially movable along the outer cylinder, wherein a brake piece extending outward in the radial direction is provided at a lower end of the second slider, and axially extends into the block. The drive assembly is provided between the first slider and the second slider, and configured to move the first slider and the second slider close to each other in the axial direction during the composite drilling, so that the brake piece engages with the block, and to move the first slider and the second slider away from each other in the axial direction during the sliding drilling, so that the brake piece disengages from the block.

In one embodiment, the block is provided with a first engagement surface, and the brake piece is provided with a second engagement surface, wherein the first engagement surface is able to fit the second engagement surface, so that the brake piece engages with the block.

In one embodiment, the first engagement surface is arranged upstream of the second engagement surface.

In one embodiment, the drive assembly includes a leaf spring, and a centrifugal block fixed in an axially middle position of the leaf spring, both ends of the leaf spring being fixedly connected to the first slider and the second slider, respectively. The centrifugal block is configured to generate, under an impact of the drive assembly, centrifugal force during the composite drilling, so that the leaf spring is deformed to expand radially, causing the first slider and the second slider move close to each other in the axial direction.

In one embodiment, two leaf springs and two centrifugal blocks are provided, and the two leaf springs are symmetrically distributed in the radial direction.

In one embodiment, the first slider and the second slider are each fixedly connected to the outer cylinder in the circumferential direction through a spline.

In one embodiment, a limiting step is provided on an inner wall surface of the outer cylinder, in order to limit a position of the second slider away from the first slider in the axial direction.

In one embodiment, the first slider and the second slider are each provided with a water hole extending in the axial direction for the drilling fluid to flow through.

In one embodiment, the turbine mechanism includes a stator fixedly connected to the turbine housing, and a rotor fixedly connected to the turbine shaft, the rotor being rotatable relative to the stator under the impact of the drilling fluid, thereby driving the turbine shaft to rotate.

In one embodiment, the valve disc mechanism comprises a movable valve disc fixedly connected to the turbine shaft, and a static valve disc fixedly connected to the turbine housing.

In one embodiment, the static valve disc and the movable valve disc are respectively provided with a first eccentric hole and a second eccentric hole, wherein an overlapping area of the first eccentric hole and the second eccentric hole is changed periodically as the movable valve disc rotates, which in turn changes the flow area of the valve disc mechanism formed by the first eccentric hole and the second eccentric hole periodically.

In one embodiment, the first eccentric hole and the second eccentric hole have the same size and eccentricity.

In one embodiment, through holes are provided on a side wall of the turbine shaft at a lower end of the turbine mechanism, so that a center flow channel in the turbine shaft is in communication with a radial annular space formed between the turbine shaft and the turbine housing.

In one embodiment, a lower joint is provided at a lower end of the turbine housing, and abuts against the static valve disc axially to limit an axial position thereof.

According to a second aspect of the present invention, a downhole drilling tool is proposed, which comprises a vibration generator, a steering motor drilling tool combination connected to a lower end of the vibration generator, and a turbine type pulse generator as mentioned above, which is connected between the vibration generator and the steering motor drilling tool combination.

Compared with the prior arts, the present application has the following advantages. During the drilling of extended reach wells and horizontal wells, the turbine type pulse generator for downhole drilling tool according to the present invention along with the vibration generator connected to an upper portion thereof is incorporated to the steering motor drilling tool combination, so that the drilling tool generates gentle vibrations periodically. In this manner, the drilling tool combination moves in the axial direction reciprocally, thereby transforming static friction into kinetic friction, and significantly reducing the friction between the well wall and the drill rod during sliding drilling. Therefore, the transmission of weight on bit can be improved, which increases the rate of penetration and enhances the extension capacity of extended reach wells and horizontal wells, so that the tool face is no longer difficult to control. In the meantime, it is able to automatically control the working state of the turbine type pulse generator through the rotation of drilling string. In the composite drilling, the turbine type pulse generator is controlled to be in the non-working state. In the sliding drilling, the turbine type pulse generator is controlled to be in the working state and generate high-frequency pulses. Accordingly, the service life of the state self-adaptive turbine type pulse generator can be significantly extended, and the resistance-reducing effect thereof can be greatly enhanced, making the directional drilling operations safer and more efficient.

BRIEF DESCRIPTION OF THE DRAWINGS

In the following, the present invention will be described with reference to the accompanying drawings.

In the present application, all accompanying drawings are schematic ones, provided to illustrate the principle of the present invention merely, and are not necessarily drawn to actual scale.

DETAILED DESCRIPTION OF EMBODIMENTS

The present invention will be described below in detail with reference to the accompanying drawings. The following detailed description is not intended to restrict the present invention, but rather should be construed as more detailed illustration of certain aspects, features and embodiments of the present invention.

Without departing from the scope or spirit of the present invention, one skilled in the art can obviously make various improvements and modifications of detailed embodiments in the description of the present invention. It would also be obvious for one skilled in the art to obtain other embodiments according to the description of the present invention. The description and the embodiments of the present application are only exemplary ones.

Figure 1:
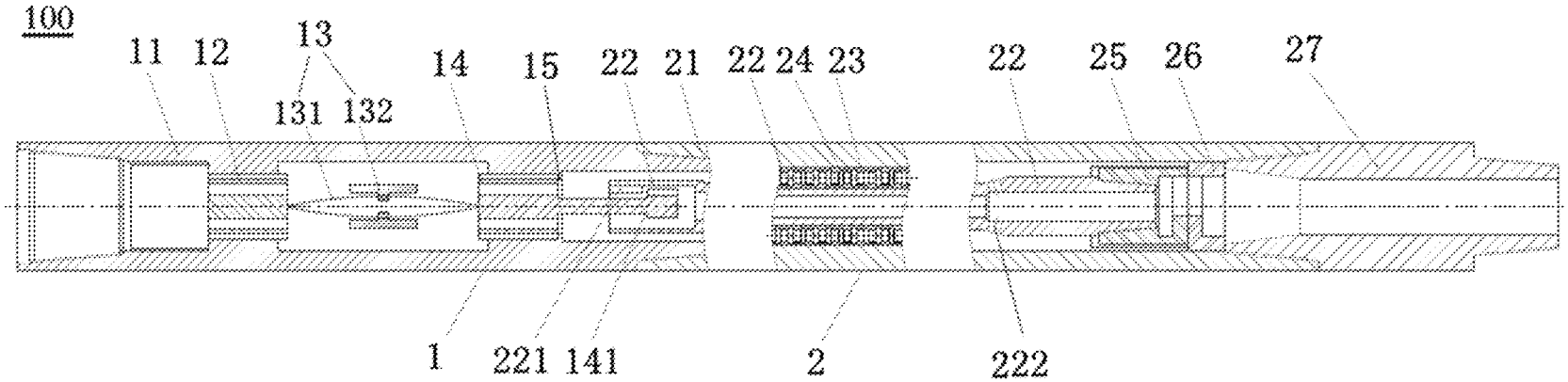
FIG. 1 shows a structure of a turbine type pulse generator for downhole drilling tool according to the present invention.

For the sake of convenience, in the present application, an end proximate to the wellhead is defined as an upper end, an upstream end, or the like, such as a left end in FIG. 1, while an end away from the wellhead is defined as a lower end, a downstream end, or the like, such as a right end in FIG. 1. Meanwhile, a direction along the length of the turbine type pulse generator is defined as a longitudinal direction, an axial direction, or the like, while a direction perpendicular thereto is defined as a lateral direction, a radial direction, or the like.

FIG. 1 shows a structure of a turbine type pulse generator 100 for downhole drilling tool according to the present invention. As shown in FIG. 1, the turbine type pulse generator 100 comprises an automatic control mechanism 1 and a pulse generating device 2. An outer cylinder 11 of the automatic control mechanism 1 is arranged at an upper end of a turbine housing 21 of the pulse generating device 2 and fixedly connected thereto. The pulse generating device 2 is configured to generate pressure pulses. Meanwhile, the automatic control mechanism 1, which is configured to control the working state of the pulse generating device 2, switches the pulse generating device 2 into a non-working state during composite drilling and into a working state during sliding drilling.

In order to facilitate installation and disassembly, the outer cylinder 11 and the turbine housing 21 are fixedly connected to each other through threads.

According to the present invention, as shown in FIG. 1, the pulse generating device 2 comprises the turbine housing 21, a turbine shaft 22 concentrically arranged inside the turbine housing 21, a turbine mechanism arranged around the turbine shaft 22, and a valve disc mechanism provided at a lower end of the turbine shaft 22. The turbine mechanism includes a stator 23 fixedly connected to the turbine housing 21, and a rotor 24 fixedly connected to the turbine shaft 22. The stator 23 is in cooperation with the rotor 24, which rotates driven by the drilling fluid. In turn, the rotor 24 drives the turbine shaft 22 to rotate. In order to enhance the driving efficiency of the drilling fluid, the turbine shaft 2 is provided with multiple stators 23 and rotors 24, which jointly drive the turbine shaft 22 to rotate under the impact of the drilling fluid.

In this embodiment, the turbine shaft 22 has a hollow structure, in order to facilitate the flow of the drilling fluid. A center flow channel extending in an axial direction is provided inside the turbine shaft 22 for the flow of the drilling fluid.

According to the present invention, the valve disc mechanism comprises a movable valve disc 25 fixedly connected to an end of the turbine shaft 22, and a static valve disc 26 fixedly connected to the turbine housing 21. The movable valve disc 25 sits on an upper end surface of the static valve disc 26. The turbine shaft 22 is able to drive the movable valve disc 25 to rotate, so that the movable valve disc 25 rotates relative to the static valve disc 26.

In one embodiment, the movable valve disc 25 is connected to the turbine shaft 22 through threads so as to facilitate installation and disassembly. In order to ensure smooth operation and reduce accident rate, the threads are tightened in the same direction as that of the rotation of the turbine shaft 22. Therefore, the threads will not be loosened when the turbine shaft 22 rotates.

The movable valve disc 25 and the static valve disc 26 are respectively provided with a first eccentric hole and a second eccentric hole of the same size and the same eccentricity. The movable valve disc 25 and the static valve disc 26 are adjacent to each other, with the first eccentric hole and the second eccentric hole being opposite each other. When the movable valve disc 25 rotates relative to the static valve disc 26, an overlapping area of the first eccentric hole and the second eccentric hole is changed periodically, which in turn changes the flow area of the drilling fluid to generate high-frequency pressure pulses.

In addition, a lower joint 27 is provided at a lower end of the turbine housing 21, and abuts against the static valve disc 26 axially to limit an axial position of the static valve disc 26. The lower joint 27 for connecting to other downhole drilling components is connected to the turbine housing 21 through threads.

Figure 2:
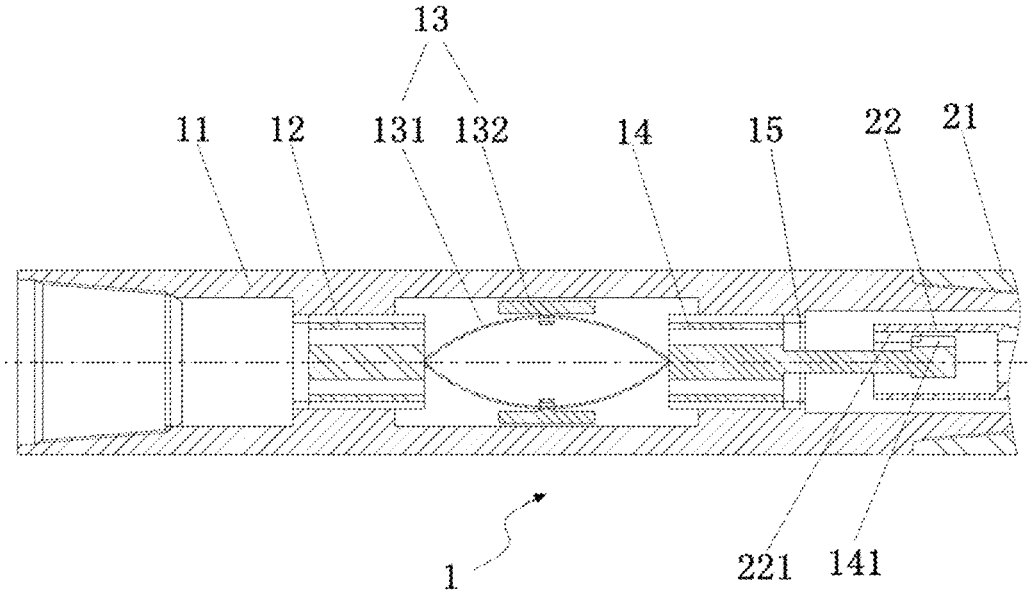
FIG. 2 shows a state of an automatic control mechanism in the turbine type pulse generator as shown in FIG. 1 during composite drilling.

According to the present invention, as shown in FIG. 1 and FIG. 2, the automatic control mechanism 1 comprises the outer cylinder 11, a movable unit arranged within the outer cylinder 11, and a drive assembly 13 for driving the movable unit to move in the axial direction. The turbine shaft 22 has a block 221 extending inward in a radial direction. The drive assembly 13 is configured to drive the movable unit to move toward and engage with the block 221 during the composite drilling, so that the turbine shaft 22 is static relative to the turbine housing 21 in a circumferential direction. Also, the drive assembly 13 is configured to drive the movable unit to move away from and disengage from the block 221 during the sliding drilling, so that the turbine shaft 22 is rotatable relative to the turbine housing 21.

The movable unit includes a first slider 12 and a second slider 14 axially spaced apart from each other within the outer cylinder 11, wherein both the first slider 12 and the second slider 14 are configured to be circumferentially fixed to and movable axially along the outer cylinder 11. A brake piece 141 extending into the block 221 and extending outward in the radial direction is provided at a lower end of the second slider 14. The drive assembly 13 is provided between the first slider 12 and the second slider 14, with both ends thereof fixedly connected to the first slider 12 and the second slider 14, respectively. The drive assembly 13 is configured to move the first slider 12 and the second slider 14 close to each other in the axial direction during the composite drilling, so that the brake piece 141 engages with the block 221. Also, the drive assembly 13 is configured to move the first slider 12 and the second slider 14 away from each other in the axial direction during the sliding drilling, so that the brake piece 141 disengages from the block 221.

According to an embodiment of the present invention, the block 221 is provided with a first engagement surface, and the brake piece 141 is provided with a second engagement surface. The first engagement surface is able to fit the second engagement surface, so that the brake piece 141 engages with the block 221. Preferably, the first engagement surface is provided upstream of the second engagement surface.

In one embodiment, the first slider 12 and the second slider 14 are each fixedly connected to the outer cylinder 11 in the circumferential direction through a spline, so that the first slider 12 and the second slider 14 do not rotate relative to the outer cylinder 11. Thus, the first slider 12 and the second slider 14 can move along the axial direction of the outer cylinder 11 only under the impact of the drive assembly 13. For example, the first slider 12 and the second slider 14 are each provided with an outer spline, while an inner spline is provided in the outer cylinder 11 in each position where the first slider 12 and the second slider 14 are arranged. Thus, the first slider 12 and the second slider 14 each fit the inner spline of the outer cylinder 11 through the outer spline. In addition, a limiting step 15 with an end facing upward is provided on an inner wall surface of the outer cylinder 11 corresponding to the second slider 14, in order to limit a position of the second slider 14 away from the first slider 12 in the axial direction.

According to an embodiment of the present invention, the drive assembly 13 includes a leaf spring 131 and a centrifugal block 132, wherein both ends of the leaf spring 131 are fixedly connected to the first slider 12 and the second slider 14, respectively. The centrifugal block 132 is fixed on an outer side of the leaf spring 131, and in an axial middle position thereof. Through the centrifugal force generated by the centrifugal block 132, the leaf spring 131 can be deformed to expand radially, so that the first slider 12 and the second slider 14 move close to each other in the axial direction.

In the embodiment as shown in FIG. 2, the drive assembly 13 includes two leaf springs 131 and two corresponding centrifugal blocks 132. The two leaf springs 131 are symmetrically provided in the radial direction. The two leaf springs 131 and the corresponding two centrifugal blocks 132 are provided to ensure smooth rotation of the outer cylinder 11. In addition, the two leaf springs 131 are symmetrically provided to further ensure smooth rotation of the outer cylinder 11. The centrifugal block 132 is provided in the center of the leaf spring 131 to ensure that the leaf spring 131 deforms from the center under the centrifugal force, so as to enhance the stability of rotation.

During actual operation, when the drill rod is drilled in a composite manner, the centrifugal block 132 of the drive assembly 13 is able to generate centrifugal force during high-speed rotation, so that the leaf spring 131 will be bent and deformed, thus expanding radially. In this manner, the first slider 12 and the second slider 14 move close to each other in the axial direction, so that the brake piece 141 engages with the block 221. FIG. 2 shows a state in which the brake piece 141 engages with the block 221, at which time the turbine shaft 22, the outer cylinder 11 and the turbine housing 21 are relatively stationary in the circumferential direction, and the pulse generating device 2 is in the non-working state. When the drill rod is drilled in a sliding manner, the drill rod and the drive assembly 13 do not rotate, so that the centrifugal block 132 does not generate centrifugal force. The leaf spring 131 returns to its original state, pushing the second slider 14 to move axially downward until it disengages from the block 221. At this time, the turbine shaft 22 rotates under the impact of the turbine mechanism and drives the movable valve disc 25 of the valve disc mechanism to rotate, so as to generate pressure pulses.

According to the present invention, the first slider 12 and the second slider 14 are each provided with a water hole for the drilling fluid to flow through, which extends in the axial direction and through the first slider 12 and the second slider 14.

The drilling fluid passes through the water holes of the first slider 12 and the second slider 14. A part of the drilling fluid flows into the center flow channel of the turbine shaft 22, and another part thereof passes through the stator 23 and the rotor 24 to drive the rotor 24 to rotate relative to the stator 23. A number of circumferentially distributed through holes 222 are provided on a side wall of the turbine shaft 22 at a lower end of the turbine mechanism, so that the center flow channel of the turbine shaft 22 is in communication with a radial annular space formed between the turbine shaft 22 and the turbine housing 21. The drilling fluid flowing in between the stator 23 and the rotor 24 drives the rotor 24 to rotate, and eventually flows into the center flow channel of the turbine shaft 22 through the radial annular space and the through holes 222. The drilling fluid entering the center flow channel passes through a flow channel formed by the first eccentric hole of the movable valve disc 25 and the second eccentric hole of the static valve disc 26. Therefore, changes in the size of the center flow channel of the turbine shaft 22 can adjust the flow rate of the drilling fluid entering between the stator 23 and the rotor 24, thereby adjusting the rotational speed of the turbine shaft 22, as well as the frequency of overlap between the eccentric holes of the movable valve disc 25 and the static valve disc 26. Accordingly, the frequency of pressure pulses of the drilling fluid passing through the eccentric holes, i.e., the frequency of pressure pulses of the pulse generator, is adjusted to meet the requirements for different operation situations on site.

In actual operation, the drill rod rotates when drilled in a composite manner, so that the outer cylinder 11 drives the centrifugal block 132 to rotate. The resulting rotating centrifugal force bends and deforms the leaf spring 131 to expand radially, so that the first slider 12 and the second slider 14 move close to each other axially. As the second slider 14 moves, the brake piece 141 thereon engages with the stop 221 on the turbine shaft 22, so that the turbine shaft 22 is circumferentially stationary relative to the turbine housing 21. Thus, the movable valve disc 25 mounted on the turbine shaft 22 stops rotating relative to the static valve disc 26, so that the pulse generator no longer generates pressure pulses. At this time, the pulse generating device 2 is in the non-working state. Since the erosion of the valve disc mechanism due to surge pressure will disappear, the service life of the valve disc mechanism can be extended. The drill rod stops rotating when drilled slidingly. In this case, the outer cylinder 11 drives the centrifugal block 132 to stop rotating, and thus the rotating centrifugal force of the centrifugal block 132 disappears. Under the spring force, the leaf spring 131 pushes the first slider 12 and the second slider 14 to move away from each other in the axial direction, until the brake piece 141 on the second slider 14 disengages from the stop 221 on the turbine shaft 22. The turbine shaft 22 continues to rotate under the impact of the drilling fluid, thereby driving the movable valve disc 25 to rotate. In this case, the pulse generating device 2 is in the working state, thus generating pressure pulses.

The turbine type pulse generator 100 for downhole drilling tool according to the present invention can be used in drilling extended reach wells and horizontal wells. The turbine type pulse generator 100 along with the vibration generator connected to an upper portion thereof is incorporated to the steering motor drilling tool combination, so that the drilling tool generates gentle vibrations periodically. In this manner, the drilling tool combination moves in the axial direction reciprocally, thereby transforming static friction into kinetic friction, and reducing the friction between the well wall and the drill rod during the sliding drilling. Therefore, the transmission of weight on bit can be improved, which increases the rate of penetration and enhances the extension capacity of extended reach wells and horizontal wells, so that the tool face is no longer difficult to control. In the meantime, the state self-adaptive turbine type pulse generator 100 is able to automatically control the working state of the turbine type pulse generating device 2 through the automatic control mechanism 1 according to actual operating conditions on site. When the drill rod is drilled in a composite manner, the turbine type pulse generating device 2 is controlled to be in the non-working state. When the drill rod is drilled in a sliding manner, the turbine type pulse generating device 2 is controlled to be in the working state and generate high-frequency pulses. Accordingly, the service life of the turbine type pulse generator 100 can be significantly extended, and the resistance-reducing effect thereof can be greatly enhanced, making directional drilling operation safer and more efficient.

The present invention further proposes a downhole drilling tool, which comprises a vibration generator, a steering motor drilling tool combination connected to a lower end of the vibration generator, and the turbine type pulse generator 100 according to the present invention connected between the vibration generator and the steering motor drilling tool combination.

Figure 3:
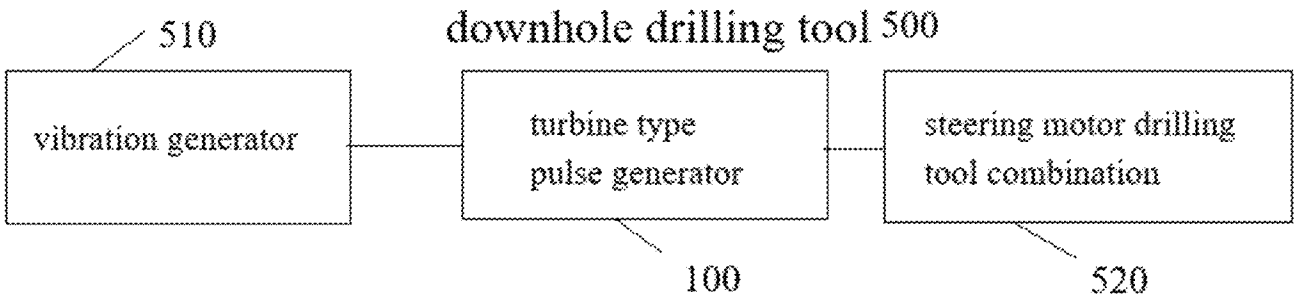
FIG. 3 schematically shows a downhole drilling tool comprising the turbine type pulse generator according to the present invention.

As schematically shown in FIG. 3, the present invention further proposes a downhole drilling tool 500, which comprises a vibration generator 510, a steering motor drilling tool combination 520 connected to a lower end of the vibration generator 510, and the turbine type pulse generator 100 according to the present invention connected between the vibration generator 510 and the steering motor drilling tool combination 520.

Finally, it should note that the foregoing description is merely illustrative of preferred embodiments of the present invention, and is not intended to restrict the present invention. Although the present invention is described in detail with reference to the above embodiments, it is still possible for one skilled in the art to modify the technical solutions defined in the above embodiments or to replace some of the technical features with equivalent ones. Any modifications, equivalent substitutions, improvements, and the like falling within the spirit and principles of the present invention are intended to be included within the scope of protection of the present invention.

The invention claimed is:

1. A turbine type pulse generator for downhole drilling tool, comprising:

a pulse generating device that comprises a turbine housing, a turbine shaft concentrically arranged inside the turbine housing, a turbine mechanism arranged around the turbine shaft, and a valve disc mechanism provided at a lower end of the turbine shaft, the turbine mechanism being configured to drive the turbine shaft to rotate relative to the turbine housing under an impact of drilling fluid so that a flow area of the valve disc mechanism is changed periodically to generate pressure pulses; and an automatic control mechanism configured to control a state of the pulse generating device, wherein the automatic control mechanism is configured to keep the turbine shaft static relative to the turbine housing in a circumferential direction during composite drilling so that the pulse generating device is in a non-working state, and to drive the turbine shaft to rotate relative to the turbine housing under an impact of the turbine mechanism during sliding drilling so that the pulse generating device is in a working state.

2. The turbine type pulse generator according to claim 1, wherein the automatic control mechanism comprises:

an outer cylinder fixedly connected to an upper end of the turbine housing;

a movable unit arranged within the outer cylinder; and a drive assembly for driving the movable unit to move in an axial direction, wherein the turbine shaft has a block extending inward in a radial direction, and the drive assembly is configured to drive the movable unit to move toward and engage with the block during the composite drilling so that the turbine shaft is static relative to the turbine housing in the circumferential direction, and to drive the movable unit to move away from and disengage from the block during the sliding drilling so that the turbine shaft is rotatable relative to the turbine housing.

3. The turbine type pulse generator according to claim 2, wherein the movable unit includes a first slider and a second slider axially spaced apart from each other within the outer cylinder, both the first slider and the second slider being circumferentially fixed to the outer cylinder but axially movable along the outer cylinder, wherein a brake piece extending outward in the radial direction is provided at a lower end of the second slider, and axially extends into the block, and the drive assembly is provided between the first slider and the second slider, and configured to move the first slider and the second slider close to each other in the axial direction during the composite drilling so that the brake piece engages with the block, and to move the first slider and the second slider away from each other in the axial direction during the sliding drilling so that the brake piece disengages from the block.

4. The turbine type pulse generator according to claim 3, wherein the block is provided with a first engagement surface, and the brake piece is provided with a second engagement surface, wherein the first engagement surface is able to fit the second engagement surface so that the brake piece engages with the block.

5. The turbine type pulse generator according to claim 4, wherein the first engagement surface is arranged upstream of the second engagement surface.

6. The turbine type pulse generator according to claim 3, wherein the first slider and the second slider are each fixedly connected to the outer cylinder in the circumferential direction through a spline.

7. The turbine type pulse generator according to claim 3, wherein a limiting step is provided on an inner wall surface of the outer cylinder, in order to limit a position of the second slider away from the first slider in the axial direction.

8. The turbine type pulse generator according to claim 3, wherein the first slider and the second slider are each provided with a water hole extending in the axial direction for the drilling fluid to flow through.

9. The turbine type pulse generator according to claim 2, wherein the drive assembly includes a leaf spring, and a centrifugal block fixed in an axially middle position of the leaf spring, both ends of the leaf spring being fixedly connected to the first slider and the second slider, respectively; and the centrifugal block is configured to generate, under an impact of the drive assembly, centrifugal force during the composite drilling so that the leaf spring is deformed to expand radially, causing the first slider and the second slider move close to each other in the axial direction.

10. The turbine type pulse generator according to claim 9, wherein two leaf springs and two centrifugal blocks are provided, and the two leaf springs are symmetrically distributed in the radial direction.

11. The turbine type pulse generator according to claim 1, wherein the turbine mechanism includes a stator fixedly connected to the turbine housing, and a rotor fixedly connected to the turbine shaft, the rotor being rotatable relative to the stator under the impact of the drilling fluid, thereby driving the turbine shaft to rotate.

12. The turbine type pulse generator according to claim 1, wherein the valve disc mechanism comprises a movable valve disc fixedly connected to the turbine shaft, and a static valve disc fixedly connected to the turbine housing.

13. The turbine type pulse generator according to claim 12, wherein the static valve disc and the movable valve disc are respectively provided with a first eccentric hole and a second eccentric hole, wherein an overlapping area of the first eccentric hole and the second eccentric hole is changed periodically as the movable valve disc rotates, which in turn changes the flow area of the valve disc mechanism formed by the first eccentric hole and the second eccentric hole periodically.

14. The turbine type pulse generator according to claim 13, wherein the first eccentric hole and the second eccentric hole have the same size and eccentricity.

15. The turbine type pulse generator according to claim 1, wherein through holes are provided on a side wall of the turbine shaft at a lower end of the turbine mechanism so that a center flow channel in the turbine shaft is in communication with a radial annular space formed between the turbine shaft and the turbine housing.

16. The turbine type pulse generator according to claim 1, wherein a lower joint is provided at a lower end of the turbine housing, and abuts against the static valve disc axially to limit an axial position thereof.

17. A downhole drilling tool, comprising:

a vibration generator;

a steering motor drilling tool combination connected to a lower end of the vibration generator; and a turbine type pulse generator according to claim 1, which is connected between the vibration generator and the steering motor drilling tool combination.

* * * * *